United States Patent [19]

Mouri et al.

[11] Patent Number: 4,642,247

[45] Date of Patent: Feb. 10, 1987

[54] RECORDING MEDIUM

[75] Inventors: Hidemasa Mouri; Michiaki Tobita, both of Yokohama; Naonobu Eto, Yamato; Shunzo Kouno, Yokosuka; Kosuke Ohkura, Hiratsuka; Shigeo Toganoh, Setagaya; Ryuichi Arai, Sagamihara; Mamoru Sakaki, Atsugi; Kazuo Iwata, Yokohama; Hiromi Shibasaki, Tokyo, all of Japan

[73] Assignee: Canon Kabushiki Kaisha, Tokyo, Japan

[21] Appl. No.: 748,819

[22] Filed: Jun. 26, 1985

[30] Foreign Application Priority Data

| | | | |
|---|---|---|---|
| Jun. 29, 1984 | [JP] | Japan | 59-133297 |
| Jul. 27, 1984 | [JP] | Japan | 59-155443 |
| Jul. 27, 1984 | [JP] | Japan | 59-155444 |
| Jul. 27, 1984 | [JP] | Japan | 59-155445 |
| Jul. 30, 1984 | [JP] | Japan | 59-157650 |
| Jul. 30, 1984 | [JP] | Japan | 59-157651 |
| Jul. 30, 1984 | [JP] | Japan | 59-157652 |
| Dec. 28, 1984 | [JP] | Japan | 59-274837 |

[51] Int. Cl.[4] ..... B41M 3/00; B41M 5/00

[52] U.S. Cl. ..... 427/214; 346/1.1; 346/135.1; 427/261; 428/143; 428/195; 428/206; 428/212; 428/213; 428/215; 428/423.1; 428/424.2

[58] Field of Search ..... 346/135.1, 1.1; 427/261, 214; 428/195, 207, 211, 423.1, 424.2, 141, 143, 206, 212, 213, 215

[56] References Cited

U.S. PATENT DOCUMENTS 4,460,637 7/1984 Miyamoto et al. ..... 346/135.1

FOREIGN PATENT DOCUMENTS 49040 4/1982 European Pat. Off. ..... 428/195
0054594 3/1984 Japan ..... 428/195

*Primary Examiner*—Bruce H. Hess
*Attorney, Agent, or Firm*—Fitzpatrick, Cella, Harper & Scinto

[57] ABSTRACT

A recording medium for recording with aqueous ink without direct contact of recording means therewith comprises an under layer and an upper layer provided thereon. The upper layer is formed of substantially water-resistant resin and is sufficiently thin to provide immediate water and air permeability and the under layer is more hydrophilic than the upper layer. There is also provided a recording process employing aqueous ink droplets and a recording medium as mentioned above.

24 Claims, 1 Drawing Figure

RECORDING MEDIUM

BACKGROUND OF THE INVENTION

1. Field of the Invention

This invention relates to a recording medium to be used suitably for the ink jet recording method, particularly a recording medium which is excellent in ink receiving characteristic, sharpness of the recorded image, paper feeding and conveying characteristic in a printer, blocking resistance, and also, when said recording medium is transparent, excellent in light-transmittance as well as ink receiving characteristic.

2. Description of the Prior Art

The ink jet recording method performs recording by generating small droplets of ink according to various systems of discharging ink (recording liquid), such as electrostatic attracting systems, systems to give mechanical vibration or displacement to the recording liquid by use of a piezoelectric element or the systems to utilize the pressure of expansion of the recording liquid by heating and ebullition, permitting them to fly and attaching a part or all thereof onto a recording medium such as paper. This method is attracting attention as a method which can reduce noise and realize high speed and multi-color printing.

The inks for ink jet recording are primarily composed of water from the view point of safety and recording characteristics, and most of them contain polyhydric alcohols, etc. added therein for prevention of clogging of nozzles and improvement of discharging characteristic.

As the recording medium to be used for the ink jet recording, there have been employed recording medium comprising conventional paper or comprising a porous ink absorbing layer provided on the base material called paper for ink jet recording. However, with improvement in performance of the ink jet recording device, such as high speed recording or multi-color recording and with popularization thereof, very exacting characteristics are becoming demanded for the recording medium. More specifically, the following requirements are to be satisfied for ink jet recording medium in order to obtain a recorded image of high resolution and high quality:

(1) Fixing of ink to the recording medium is as rapid as possible.

(2) When ink dots are overlapped, the ink attached later should not flow out into the ink dot previously attached.

(3) Although the ink droplets may be somewhat diffused on the recording medium, the size of ink dot should be of the desired size or no greater than the desired size than is necessary.

(4) The shape of ink dot should approximate a true circle, and its circumference should be smooth.

(5) The OD (optical density) of the ink dot should be high, without obscurity around the dot.

Further, in order to obtain a recorded image of high resolution, which is comparable to the color photography, by the multi-color ink jet recording method, in addition to the above requisite performances, the following requirements should also be satisfied:

(6) The color forming characteristic of the coloring components of ink should be excellent.

(7) Since as many droplets as the number of colors of ink may be attached on the same spot overlapped on one another, the ink fixing characteristic should particularly be excellent.

(8) The surface should have lustre.

(9) The medium should have a high degree of whiteness.

(10) The medium should be fed and conveyed smoothly in a printer.

The images by ink-jet recording have been employed only for observation of surface images, but a recording medium is now demanded, which are suitable for uses other than surface image observation, as the ink jet recording device is improved in performance and widely used. The uses other than surface image observation may include those in which recorded images are projected by means of optical instruments such as slides or OHP (overhead projector) on a screen, etc. for observation of those images, color separating plates for preparation of positive plates for color printing, CMF (color mosaic filter) for color display of liquid crystal, etc.

While the diffused light of a recorded image is primarily observed when the recorded image is to be used for surface image observation, the transmitted light passing through the recorded image is a matter of importance in a recording medium to be used in uses other than surface image observation. Accordingly, the recording medium to be used for these uses is required to have excellent light transmitting characteristic, particularly linear transmission factor, in addition to the performances required for recording media for ink jet recording in general as described above.

However, no recording medium has yet been known, which satisfies all of these requisite performances.

Most of the recording media for observation of surface images employ the system in which a porous ink-absorbing layer is provided on the surface and the recording liquid is absorbed into the porous voids to fix the recording agent.

On the other hand, when the surface of the ink absorbing layer is non-porous, non-volatile components such as polyhydric alcohols in the ink will remain on the surface of recording medium for a long time after recording, and a long time is necessary before drying and fixing of the ink, whereby there have been involved the drawbacks such as contamination of clothes or damaging of the recorded images.

European Patent Application No. 0049040 discloses a composite medium for sorbing liquids comprising, in combination, a liquid-sorbent underlayer and, overlying said underlayer, a liquid-permeable surface layer capable of retaining its integrity in contact with said liquid and liquid applying means, the liquid sorptivity of said underlayer being greater than the liquid sorptivity of said surface layer. The composite medium is useful as a recording medium for mechanical plotters employing organic ink. However, the liquid permeable surface layer is primarily intended for retaining the integrity of the surface of the medium to enable the rapid pen movement and to prevent clogging of the tip of the pen caused by gouging of the surface of the medium. On the other hand, the present invention does not require such property of retaining the integrity of the surface since recording means does not contact with the recording medium and the rigidity of the layer overlying the ink-absorbing under layer rather causes troubles: the rigidity of the layer will suppress the swelling of the under layer to reduce the ink-retention ability and to induce blurring.

SUMMARY OF THE INVENTION

An object of the present invention is to provide a recording medium for ink jet recording, which is particularly excellent in ink receiving characteristic and sharpness of recorded images.

Another object of the present invention is to provide a transparent recording medium for ink jet recording, which can be used for observation of transmitted light such as for observation of projected images on a screen, etc. by optical instruments such as a slide or OHP, color separating plate in preparation of a positive plate in color printing, or CMF, etc. to be used in color display such as liquid crystal.

Further object of the present invention is to provide a recording medium for ink jet recording which has qualities commonly required for improvement of commerical values such that the recording medium when applied on a printer may be smoothly fed and conveyed without jamming, namely having good delivering characteristics, that the recording medium may be free from blocking by adhesion with a coating agent, etc. during storage of the recording medium, and that no fingerprint may be formed by finger touch.

Extensive studies have been made to accomplish the above objects, and consequently it has been rendered possible to obtain a recording medium excellent in ink receiving layer by constituting the ink receiving layer of two layers of an under layer and an upper layer, preferably of three layers further comprising a fine powdery layer, the under layer having an ink-retaining property and the upper layer being ink-permeable.

However, when recording is effected on the above recording medium with a large amount of ink, although the ink can be received, the printed portion becomes turbid, which turbid portion gives a dark projected image when employed for observation of transmitted light by OHP, etc., thereby ensuing sometimes a problem that the color forming characteristic may be lowered.

Accordingly, further studies have been made to obtain a recording medium without turbidity at the printed portion and yet having excellent ink receiving characteristic and color forming characteristic.

According to an aspect of the present invention, there is provided a recording medium for recording with aqueous ink without direct contact of recording means therewith comprising an under layer and an upper layer provided thereon, wherein the upper layer is formed of substantially water-resistant resin and is sufficiently thin to provide immediate water and air permeability and the under layer is more hydrophilic than the upper layer.

According to another aspect of the present invention, there is provided a recording process employing aqueous ink droplets and a recording medium comprising a lower layer and an upper layer provided thereon, wherein the upper layer is formed of substantially water-resistant and is sufficiently thin to provide immediate water and air permeability and the lower layer is more hydrophilic than the upper layer.

DETAILED DESCRIPTION OF THE INVENTION

Figure 1:
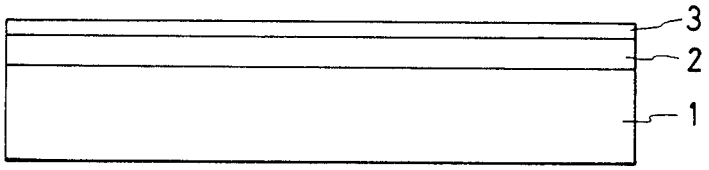
FIG. 1 shows an sectional view of a recording medium according to the present invention.

Referring to the drawing, there is shown an embodiment of the recording medium comprising a substrate 1, an under layer 2, and an upper layer 3.

The present invention provides a recording medium characterized by having an under layer and an upper layer. More specifically, the recording medium of the present invention is characterized by providing an upper layer with specific properties on its under layer, and the objects of the present invention have been accomplished primarily by such a constitution.

The upper layer of the present invention is made of a flexible or elastic material, and will deform to protect the recorded images corresponding to deformation of the under layer swollen by the unevaporated portion of the aqueous ink after completion of recording.

In another embodiment, the present invention provides a recording medium having an under layer and an upper layer, in which the upper layer comprises a polyurethane type resin. More specifically, the recording medium of the present invention is characterized primarily by providing an upper layer on its under layer.

Further, the present invention provides a recording medium having an under layer and an upper layer, in which the thickness of the under layer is greater than that of the upper layer. More specifically, the recording medium of the present invention is characterized primarily by providing on its under layer an upper layer of specific properties which is thinner in thickness than said under layer.

In still another embodiment, the present invention provides a recording medium having an under layer and an upper layer, in which the upper layer has a thickness of 10 $\mu$m or less. More specifically, the recording medium of the present invention is characterized primarily by providing on its under layer an upper layer of specific properties having a thickness of 10 $\mu$m or less.

Also, the present invention provides a recording medium, having an under layer and an upper layer, in which powder is imparted onto the upper layer. More specifically, the recording medium of the present invention is characterized by providing an upper layer of specific properties on its under layer, and further imparting powder onto said upper layer.

In further embodiment, the present invention provides a recording medium, having an under layer, an upper layer and a fine-powder layer, in which the under layer comprises a water-soluble resin and the upper layer comprises a hydrophilic polyurethane type resin.

More specifically, the recording medium of the present invention is characterized primarily by providing on an under layer comprising a water-soluble resin an upper layer comprising a hydrophilic polyurethane type resin and further a fine-powder layer on said upper layer, and the objects of the present invention have been accomplished primarily thereby.

In still another aspect, the present invention provides a recording medium, having an under layer, upper layer and a fine-powder layer, in which the upper layer comprises a polyurethane type resin.

More specifically, the recording medium of the present invention is characterized primarily by providing on the under layer an upper layer comprising a polyurethane type resin and further a fine-powder layer on said upper layer.

Further, the present invention provides a recording medium, having an ink receiving layer comprising an under layer and an upper layer, in which the upper layer comprises a polyurethane type resin having a thickness of 0.01 to less than 0.1 μm.

More specifically, the recording medium of the present invention is characterized primarily by providing on the under layer an upper layer comprising a polyurethane type resin with a specific thickness, namely 0.01 to less than 0.1 μm, and preferably further providing a fine-powder layer on said upper layer.

The recording medium of the present invention generally comprises a base material as the substrate, an under layer provided on its surface and an upper layer provided on said under layer.

Also, the recording medium of the present invention generally comprises a base material as the substrate, an under layer provided on its surface and an upper layer made of a polyurethane type resin provided on said under layer.

Further, the recording medium of the present invention generally comprises a base material as the substrate, an under layer provided on its surface, an upper layer provided on said under layer and powder imparted onto the upper layer.

Also, the recording medium of the present invention may generally comprise a base material as the substrate, an under layer comprising a water-soluble resin provided on its surface, an upper layer made of a hydrophilic polyurethane type resin provided on said under layer and a fine-powder layer as the uppermost layer.

Alternatively, the recording medium of the present invention may generally comprise a base material as the substrate, an under layer provided on its surface, an upper layer made of a polyurethane type resin provided on said under layer and a fine-powder layer as the uppermost layer.

The recording medium of the present invention generally may comprise a base material as the substrate, an under layer provided on its surface and an upper layer made of a polyurethane type resin with a specific thickness, and preferably a fine-powder layer as the uppermost layer. For example, particularly preferred embodiments may include:

(1) the embodiment in which the base material, the under layer and the upper layer are all transparent, and the recording medium as a whole is transparent, (2) the embodiment in which at least one of the base material, the under layer and the upper layer is opaque, and the recording medium as a whole is opaque;

(3) the embodiment in which the base material, the under layer, the upper layer and the fine-powder layer are all transport and the recording medium as a whole is transparent; and (4) the embodiment in which at least one layer of the base material, the under layer, the upper layer and the fine-powder layer are opaque and the recording medium as a whole is opaque.

In any of the above cases, the under layer may also have the function of a substrate.

To describe in detail about the present invention by referring to the four kinds of preferred embodiments as mentioned above, the base material to be used as the substrate in the present invention may include all of transparent and opaque base materials known in the art. Preferable examples of transparent base materials may include films or plates of polyester type resins, diacetate type resins, triacetate type resins, acrylic type resins, polycarbonate type resins, polyvinyl chloride type resins, polyimide type resins, Cellophane, Celluloid, etc. and also glass plates. Preferable examples of opaque base materials may include papers in general, cloths, wood materials, metal plates, synthetic papers, and also those materials obtained by subjecting the above transparent base materials to the opacifying treatment according to known means. Such base materials should preferably have thicknesses within the range of from about 10 to 200 μm.

In the present invention, the under layer characterizing the present invention to be provided on the above base material is formed primarily a water-soluble or hydrophilic material which can receive an aqueous ink. Preferable examples of such materials may include natural materials such as albumin, gelatin, casein, starch, cationic starch, gum arabic, sodium alginate, etc., synthetic resins such as polyamide, polyacrylamide, polyvinyl pyrrolidone, quaternized polyvinyl pyrrolidone, polyethyleneimine, polyvinylpyridinium halide, melamine resin, polyurethane, carboxymethyl cellulose, polyvinyl alcohol, cation-modified polyvinyl alcohol, polyester, sodium polyacrylate, etc. Further, most preferable materials in the present invention are water-soluble resins such as polyvinyl pyrrolidone, polyvinyl alcohol and/or polyacrylic resins, which can retain an ink of several-fold of its own weight rapidly and stably. At least one of these materials may be used as desired.

Further, for reinforcement and/or improvement of adhesion to the base material of the under layer, it is also possible to use, in combination with the above water-soluble resin, a resin such as SBR latex, NBR latex, polyvinyl formal, polymethyl methacrylate, polyvinyl butyral, polyacrylonitrile, polyvinyl chloride, polyvinyl acetate, phenol resin, alkyd resin, etc., if desired.

As the preferable method for forming such an under layer, the polymer as mentioned above, either singly or as a mixture, may be dissolved or dispersed in an appropriate solvent to prepare a coating liquid, which coating liquid is then applied on said base material according to the known method such as roll coating, rod bar coating, air knife coating, spray coating, etc., followed by drying rapidly. It is also possible to form a single under layer from the material as mentioned above according to the thermal spreading method, the T-die method, etc. and use the under layer while giving also the function of the substrate. Alternatively, said sheet may be laminated on the above substrate. Further, the above polymer material may be subjected to hot melt coating to form an under layer on the substrate.

The thickness of the under layer thus formed may be within the range which can retain ink and is not particularly limited, provided that it is at least 0.1 μm, although the particular thickness employed may depend on the amount of the ink to be recorded. Practically, a thickness of 0.5 to 30 μm is preferable, but it is essentially required to be larger than the thickness of the upper layer as hereinafter described.

The upper layer to be used in the present invention, which characterized primarily the present invention, is a thin layer made of a natural or synthetic resin, particularly a thin layer made of a polyurethane type resin, above all a hydrophilic polyurethane type resin, provided on the under layer formed as described above. It has the function, when small droplets are attached on its surface, of enlarging the contact area rapidly (e.g. within several seconds) to the extent that same small droplets may not excessively overlapped with adjacent other droplets, and also promoting penetration of the ink into the under layer and reception of the ink by the under layer.

Extensive studies have been made in order to impart the function as mentioned above to the under layer, and unexpectedly found that the above function can easily be accomplished by forming on said under layer a thin layer comprising a polymer equal or inferior in hydrophilicity to the polymer constituting the under layer. Such a function has also been accomplished by a thin film which is completely or substantially insoluble in water.

Particularly, when a polyurethane type resin (including hydrophilic polyurethane resin insoluble in water) is used as said polymer, such a function has been accomplished in the case of forming a thin layer of said polymer which is thinner than the under layer and also in the case of forming a thin layer of said polymer with a thickness of 10 μm or less. In addition, as the result of studies with the greatest aim to impart such a function as described above to the under layer and further afford projection of a beautiful image by OHP even immediately after printing by a color ink jet printer, it has also been found that the above function can easily be accomplished by providing an upper layer less than 10 μm. It is surprizing enough that such a function has been accomplished even by a thin layer of a hydrophilic polyurethane type resin substantially insoluble in water.

The upper layer having the function as described above was accomplished by forming a thin layer with a thickness in the range of about 10 μm or less, preferably 5 μm or less, more preferably from 0.01 to 0.1 μm with a polymer having hydrophilic property which is equal to the polymeric material forming the under layer, particularly a polyurethane type resin or a polymer which is relatively inferior in hydrophilic property, particularly a polyurethane type resin.

As the polymeric material useful for formation of such a thin layer, it is preferable to select one equal to or inferior to the under layer in hydrophilic property from homopolymers or copolymers of vinyl acetate, acrylates, ethylene, vinyl chloride and other vinyl monomers, and polymers comprising the vinyl monomers as mentioned above and various hydrophilic vinyl monomers, and further polymers such as Vinylone, polyurethane, cellulose derivatives, polyester, polyamide, etc. and the hydrophilic polymers for formation of the under layer as described above, either singly or a mixture thereof.

The polyurethane type resin material useful for such a thin layer is an addition polymer of a polyisocyanate compound and a compound having two or more active hydrogens such as polyol, polyamine, polycarboxylic acid, any of such polymers known in the art may be available. Particularly preferable materials are those prepared by use of NCO terminated urethane prepolymers from the reaction of a polyisocyanate compound and a polyol compound under NCO excessive conditions, and crosslinking by polymerization with an appropriate chain elongating agent such as water, hydrazine, a low molecular weight polyol, a low molecular weight polyamide, a low molecular weight alcohol amine, etc.

The polyisocyanate useful for formation of a polyurethane or a urethane prepolymer may include those having two isocyanate groups such as 1,2-diisocyanate ethane, 1,2-diisocyanate propane, tetramethylene-1,4-diisocyanate, pentamethylene-1,5-diisocyanate, hexamethylene-1,6-diisocyanate, nonamethylene-1,9-diisocyanate, decamethylene-1,10-diisocyanate, ω,ω'-dipropyl ether diisocyanate, cyclohexane-1,4-diisocyanate, dicyclohexylmethane-4,4'-diisocyanate, hexahydrodiphenyl-4,4'-diisocyanate, hexahydrodiphenyl ether-4,4'-diisocyanate, phenylene-1,4-diisocyanate, tolylene-2,6-diisocyanate, tolylene-2,4-diisocyanate, 1-methoxybenzene-2,4-diisocyanate, 1-chlorophenylene diisocyanate, tetrachlorophenylene diisocyanate, m-xylylene diisocyanate, p-xylylene diisocyanate, diphenylmethane-4,4'-diisocyanate, diphenylsulfide-4,4'-diisocyanate, diphenylsulfone-4,4'-diisocyanate, diphenylether-4,4'-diisocyanate, diphenylether-3,4'-diisocyanate, diphenylketone-4,4'-diisocyanate, naphthalene-1,4-diisocyanate, naphthalene-1,5-diisocyanate, 2,4'-biphenyl diisocyanate, 4,4'-biphenyl diisocyanate, 3,3-dimethoxy-4,4'-biphenyl diisocyanate, anthraquinone-2,6-diisocyanate, triphenylmethane-4,4'-diisocyanate, azobenzene-4,4'-diisocyanate and the like.

The compounds containing 3 isocyanate groups may include those represented by the formulae (I)–(IV) and derivatives thereof, and one or more compounds may be chosen and used as desired for formation of a polyurethane or a urethane prepolymer.

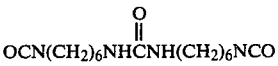
(I)

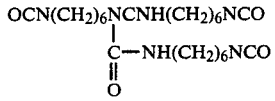
(II)

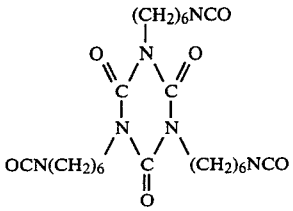
(III)

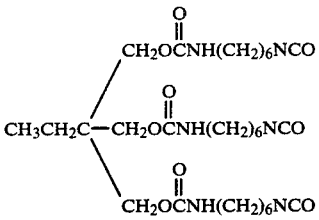
(IV)

The compounds having two or more active hydrogens may preferably be hydrophilic polyols, including suitably polyester polyols, polyether polyols and polyester polyether polyols. Polyester polyols are compounds produced from polybasic acids and polyhydroxy compounds, and hydroxy-terminated polyesters are preferred. As the polybasic acids, there may be employed saturated fatty acids such as oxalic acid, succinic acid, adipic acid, pimelic acid, etc., unsaturated fatty acids such as maleic acid, fumaric acid, etc., aromatic acids such as phthalic acid, isophthalic acid, etc. or anhydrides thereof either singly or as a mixture and, as polyhydroxy compounds, one or a mixture of two or more compounds selected from diols such as ethylene glycol, diethylene glycol, triethylene glycol, propylene glycol, etc., triols such as trimethylolpropane, trimethylolethane, hexane triol, glycerine, etc. and hexaols such as sorbitol, etc.

Since such polyester polyols have generally low hydrophilicity, when a hydrophilic polyurethane type resin is desired, a compound having unsaturation is used as a part of the starting polybasic acid to be converted into a polyester polyol or a polyurethane, followed by hydrophilic modification of the polymer according to a known method such as introduction of sulfonic acid groups or cationic groups or grafting of a water-soluble monomer through utilization of the existing unsaturation.

The polyether polyol to be used in the present invention is a compound containing two or more hydroxyl groups in one molecule and also has an ether linkage, including homopolymers or copolymers of ethylene oxide (EO) or propylene oxide (PO), and polyols formed by addition of EO or PO in any desired manner to polyhydric alcohols such as glycerin, trimethylolpropane, hexanetriol and other triols, sorbitol or other hexaols or amines such as ethylenediamine, benzenesulfamide, 2-aminoethanolamine, N-methyldiethanolamine, diethylenetriamine, amines having aromatic groups, etc., or derivatives thereof. These may be used either singly or as a mixture of two or more compounds. The polyester polyether polyol may be obtained by condensation of the polybasic acids and the polyether polyols as described above so as to form terminal hydroxyl groups.

Other polyols may include castor oil, tall oil or derivatives thereof, acrylic polyol, urethane polyol, etc. Further, the low molecular weight polyhydric alcohols as mentioned above can also be used as the polyol component. Besides, as a matter of course, various polyols as described above can be used either singly or as a mixture.

In the preparation of a polyurethane, the low molecular weight polyols, the low molecular weight diamines, the low molecular weight alcohol amines, water or hydrazine may be used as the chain elongating agent.

Preparation of the polyurethane or isocyanate-terminated urethane prepolymer comprising the components as mentioned above can be carried out to the known method. As the isocyanate-terminated urethane prepolymer, it is of course possible to use a commercially available one, for example, a prepolymer which is an addition product of tolylene diisocyanate with various polyester polyols or polyether polyols, having terminal isocyanate groups.

Further, as the urethane polymer, a blocked urethane prepolymer stabilized by blocking of its terminal NCO groups may be used.

Also, the polyurethane or urethane prepolymer may be used in combination with other polymers as mentioned above, for example, homopolymers or copolymers of vinyl acetate, acrylates, ethylene, vinyl chloride and other vinyl monomers, and polymers comprising the vinyl monomers as mentioned above and various hydrophilic vinyl monomers, and further polymers such as Vinylone, polyurethane, cellulose derivatives, polyester, polyamide, etc. and the hydrophilic polymers for formation of the under layer as described above.

The polymers as described above may be used in the form of a solution in an organic solvent, but also in the form of an emulsion in an aqueous medium or a micro-dispersion in an organic solvent or an aqueous medium. Anyway, the polymers should preferably be used as a relatively dilute solution or at such a concentration that the polymer solution gives a layer within the above range.

The upper layer may be formed with the use of the materials as described above according to the same method as employed for formation of the aforesaid under layer.

To describe in detail, the upper layer, which is formed by coating the resin solution as described above to a certain thickness on the under layer, followed by drying, should preferably be formed so that micro-pores may be formed in the thin layer formed by the treatment during drying or after drying.

Preferable methods for forming such a microporous thin film may include, for example:

(1) the method for formation of a microporous layer in which gas is generated through reaction with moisture during thin layer formation as in the moisture-curable urethane polymer, and the portions where gas was evaporated remain as micro-pores in the thin layer;

(2) the method for formation of micro-pores, in which an inorganic or organic fine powdery foaming agent is mixed or dissolved into the above resin dissolved or dispersed in a polar or non-polar solvent and the foaming agent is permitted to foam by applying temperature during or after formation of the thin layer on the under layer;

(3) the method for formation of micro-pores, in which a relatively incompatible volatile solvent is dispersed, emulsified or solubilized in the resin solution to be used in (2) and evaporated during or after formation of the thin layer;

(4) the method for formation of a microporous thin film, in which a material with greater solubility in the organic solvent or water than the resin in the above resin solution, for example, a low molecular weight material or polymer is mixed in said resin solution, and after formation of the thin layer from the resin solution, the material with great solubility mixed therein is dissolved with an organic solvent or water which does not impair the thin layer formed or the ink receiving layer;

(5) the method in which a polyurethane thin layer generally known as the ultra-filtration film, namely, resin filtration film, reverse osmosis thin film, dialysis film, precision filtration film, etc. is laminated;

(6) the method in which an emulsion or a dispersion of a polyurethane or a urethane prepolymer in an organic solvent or water is applied by coating, and dried at a temperature, at which the emulsion of dispersion particles will not be fused or excessively fused with each other to form a layer comprising polyurethane particles.

In the methods as described above, the moisture-curable urethane prepolymer to be employed may preferably a NCO-terminated urethane prepolymer obtained by the reaction of a polyisocyanate and a polyol under NCO excess condition; the volatile solvent to be used in another method may preferably be benzene, toluene, acetone, lower alcohols, petroleum solvents, water, etc.; inorganic or organic foaming agents may preferably be ammonium carbonate, sodium hydrogen carbonate, ammonium nitrate, dinitrosopentamethylenetetramine, azodicarbonamide, azobisisobutyronitrile, p-toluenesulfonyl hydrazide, 4,4'-oxy-bis(benzenesulfonyl hydrazide), diazoaminobenzene, diphenylsulfone-3,3'-disulfonyl hydrazide, etc.; the soluble material to be employed in the method (4) may be either a low molecular weight material or a polymer, provided that its solubility is greater than the resin for the film forming material, and this method is particularly suitable when the thin layer is a cured or crosslinked film; and the particle size of the emulsion or the dispersion to be used in the above method (6) should preferably be within the range of from about 0.01 to 0.5 μm.

The upper layer comprising a polyurethane type resin thus formed may have a thickness which may, depending on the amount of ink required, is not particularly limited, if it is 10 μm or less. Practically, a thickness in the range of from 0.1 to 5 μm is preferred. Although it is possible to form an upper layer by use of a material which will be swelled with or dissolved in aqueous ink to coalesce micropores after passage of the aqueous ink, it is generally preferred to choose a material for forming the upper layer which will not readily be swelled with or dissolved in aqueous ink so that it may be provided for use even under severe conditions of high temperature and high humidity and also the under layer may be protected under such conditions.

The pore sizes of the porous upper layer as prepared above may sufficiently be 0.2 nm or more, since the sizes of water particles are generally considered to be 0.2 μm. However, in practical production, the pore sizes may be varied from about 2 nm at the minimum to several μm, and all of these sizes may be suitable, but pore sizes over 100 nm with make the layer opaque and therefore pore sizes should preferably be not greater than 100 nm as the transparent recording medium.

For formation of the upper layer by use of the materials as described above, the same method as that formation of the under layer may be employed. However, when the thickness of the upper layer is required to be in the range of 0.01 to 0.1 μm, if the thickness of the upper layer exceeds 0.1 μm, the printed letter portion will become turbid in performing recording with a large quantity of ink, whereby the projected image of such a recorded image by OHP, etc. will suffer from scattering of light at the turbid portion to become dark at the recorded portion of the projected image, thus failing to give desirably inherent color formation of inks. On the other hand, if the upper layer has a thickness less than 0.01 μm, no improvement of the ink receiving characteristic by the upper layer can disadvantageously be obtained.

The recording medium of the present invention having such a basic constitution as described above, when its upper layer has a thickness less than that of the under layer, when the thickness of the upper layer is 10 μm or less, and when the upper layer has a thickness of 0.01 to 0.1 μm, in spite of its hydrophilicity equal or inferior to that of the under layer, is surprisingly improved markedly in ink receiving characteristic and ink fixing characteristic as compared with the recording medium having no such upper layer of the prior art.

At present, although its theoretical ground is not clear, it is considered that the above upper layer does not exist necessarily as a continuous coating, but minute voids through which aqueous ink can penetrate into the under layer exist in infinite number and their surfaces are microscopically irregular, and consequently the ink droplets attached can be diffused quickly on their surfaces to enlarge the contact areas thereof, whereby the ink absorbability by the under layer and fixing characteristic can markedly be promoted.

Also, since the upper layer of the recording medium of the present invention is formed of a hydrophilic polyurethane equal or inferior in hydrophilicity to the under layer as a thin layer with a thickness of 0.01 to less than 0.1 μm, the ink attached on the surface will not remain in the upper layer with low ink retaining capacity, but quickly pass through the upper layer to be retained and fixed in the under layer with greater ink retaining capacity.

The recording medium of the present invention, of which upper layer can be formed of a polyurethane having equal or inferior in hydrophilicity to that of the under layer, is free from contamination of instruments, operator or environments through exudation of the ink once received even in an atmosphere of high temperature and high humidity, and also scarcely suffer from tackiness of the surface under high temperature and high humidity conditions.

Further, the powder to be used in the present invention which characterizes further the present invention is imparted onto the above upper layer, having the function of exhibiting excellent ink fixing characteristic and smooth delivering characteristic when the recording medium is applied on a printer and also cancelling the blocking characteristic when a number of sheets of recording medium were piled on one another.

Intensive investigation have been performed to have the functions as mentioned above exhibited, and consequently it has been found that the above function could be accomplished by imparting some kinds of powder onto the upper layer.

The powder having the above function may preferably fine powder having a particle size of 20 μm or less, as exemplified by inorganic powder such as silica, clay, talc, diatomaceous earth, calcium carbonate, calcium sulfate, barium sulfate, aluminum silicate, synthetic zeolite, alumina, zinc oxide, lithopone, satin white, etc., or organic powder such as higher fatty acids or salts thereof (e.g. aluminum stearate, calcium stearate, etc.), anionic, cationic, nonionic or amphoteric surfactants which are solid at normal temperature (e.g. sodium dodecylbenzenesulfonate, sodium laurylsulfonate, potassium laurylsulfonate, sodium stearylsulfonate, polyethyleneglycol nonylphenyl ether with a relatively high HLB, etc.). Such powder may preferably be imparted onto the upper layer at a proportion of 0.01 to 1.0 $g/cm^2$.

The materials as mentioned above can be applied directly as powdery particles, or as a dispersion or a suspension in an appropriate fluid (e.g. water). The method for imparting the above material to the upper layer may be, for example, dipping, brush coating, spraying, roller coating, electrostatic adsorption, etc.

The preferable recording medium of the present invention having the basic constitution as described above is improved markedly in ink receiving characteristic, ink fixing characteristic, blocking resistance, fingerprint resistance and delivering characteristic in a printer, as compared with the recording medium having no powder on the upper layer.

The powder imparted onto the upper layer, due to a large number of voids like capillary possessed by between particles and the particles themselves, will enable rapid diffusion of ink through the powder by the capillary phenomenon thereof, whereby the ink can reach the upper layer with a broad area. Therefore, it is considered that the synergistic action with the powder imparted to the upper layer improves markedly ink receiving characteristic, ink fixing characteristic and delivering characteristic.

Further, since the powder is imparted onto the uppermost layer, the functions considered to be important in practical application such as no attachment of fingerprint or no occurrence of blocking on piling of sheets of recording medium can also be exhibited at the same time.

The present invention has the basic constitution as described above and, in the embodiment of a transparent recording medium, a transparent material is employed as the substrate and it is also necessary not to impair light-transmittance of the ink under layer, the upper layer and the fine powdery layer during formation of such layers. However, to the extent which does not impair their transmittance, it is also possible to disperse a filler such as silica, clay, talc, diatomaceous earth, calcium carbonate, calcium sulfate, barium sulfate, aluminum silicate, synthetic zeolite, alumina, zinc oxide, lithopone, satin white, etc. in the under layer and/or the upper layer.

The sufficient light-transmittance as herein mentioned refers to a linear transmission factor (or straight line light transmittance) defined below which exhibits at least 2% or higher, preferably 10% or higher.

If the linear transmission factor is 2% or higher, observation of the recorded image by way of projection on a screen, for example, by OHP may be possible, and a linear transmission factor of greater than 10% is desirable for enabling clear observation of the minute portions of the recorded image.

The linear transmission factor (T %) as mentioned in the present invention refers to the spectral transmittance of the straight line light, which enters a sample, travels through said sample, passed through the slit on the light-receiving side at a distance of at least 8 cm apart from said sample on the line elongated from the incident optical path and is received at the detector, as measured by means of, for example, Model 323 Hitachi Auto-recording Spectrophotometer (mfd. by Hitachi Seisakusho), and further determined from the measured spectral transmittance according to the following formula with the use of Y values of the tristimulus values of color:

$$T = Y/Y_0$$

T: linear transmittance factor;
Y: Y value of the sample; and
$Y_0$: Y value of the control.

Thus, the linear transmission factor is relative to the straight line light, and the method for evaluation of the light transmitting characteristic of the recording medium by use of linear transmission factor is different from the methods for evaluation of light transmitting characteristic by use of diffused light such as diffused transmitted light (transmittance inclusive also of diffused light is determined by providing an integrating sphere at the rear portion of the sample) or opacity (white and black backings are lined on the back of the sample, and the opacity is determined from the ratio of both cases).

The problems in the instruments utilizing optical technique are caused primarily through behaviors of straight line light, and therefore it is particularly important to determine the linear transmission factor of a recording medium for evaluation of the light transmitting characteristic of the record-bearing member to be used for these instruments.

For example, when a projected image is to be observed by OHP, in order to obtain an image which can clearly and easily be viewed with high contrast between the recorded portion and the non-recorded portion, the non-recorded portion at the projected image is required to be light, namely the linear transmission factor to be at a certain level or higher. According to the test by a test chart in OHP, for obtaining an image suited for the above purpose, the linear transmission factor through the recording medium is required to be 2% or higher, preferably 10% or higher in order to obtain a sharper image, more preferably 50% or higher. Thus, the recording medium suited for this purpose is required to have its linear transmission factor of 2% or higher.

On the other hand, in embodiments of the present invention in which the recording meduim is opaque, an opaque material should be used for at least one layer of the constituent layer, namely the substrate, the under layer, the layer and the fine powder layer.

The methods for forming the respective layers in opaque embodiments are the same as in the transparent embodiment as described above. In the opaque embodiment, in formation of the ink under layer and the upper layer, a large amount of the fillers as mentioned above can be used to the extent as will not impair film forming property, thereby further enhancing excellent ink receiving characteristic and fixing characteristic.

Having described above about the present invention by referring to representative embodiments of the recording medium of the present invention, the recording medium of the present invention is not of course limited to these embodiments. In any of the embodiments, it is also possible to include various known additives in the under layer and/or the upper layer, such as dispersants, fluorescent dyes, PH controlling agents, defoaming agents, lubricants, preservatives, surfactants, etc. Also, in the upper layer, there may be further contained as the yellow discoloration preventive various stabilizers, including organic tin stabilizers such as dibutyltin maleate, dioctyltin mercaptide, etc. or other stabilizers such as polyphosphite, trisnonylphenyl phosphite, etc.

The recording medium of the present invention is not necessarily be required to be colorless but it may also be a colored recording medium.

The recording medium of the present invention as described above is markedly improved in receiving and fixing of ink as verified by the Examples as hereinafter described. For example, as a matter of course in the case of the monochromatic color, even in recording of full color, when recording liquids with different colors may be attached on the same spot in overlapping fashion in a short time, there is no such phenomenon of flowing-out or exudation of the recording liquids, and an image of high resolution is obtained which is also clear and excellent in color developability. Also, when employed for observation by projection of the recorded image onto a screen, etc. by means of an optical instrument such as slide of OHP, since the small ink droplets attached are fixed with enlargement to the extent so as not to be overlapped with adjacent other regions so excessively as compared with the case of the recording medium of the prior art, the transmitted light can be more uniform to give a projected image with excellent uniform image density. Further, it is also suitably applicable for uses other than conventional surface image observation such as color separating plates in preparation of positive plates for color printing, CMF to be used for color display such as liquid crystal, etc.

The ink used for recording on the recording paper of this invention contains water (a solvent) and a water-soluble dye (a colorant) as the indispensable components. The water-soluble dye used is selected widely from known direct dyes, acid dyes, and basic dyes. Suitable contents of these colorants in the ink are 0.5–30%, preferably 1–20%, by weight. Solvents used for the ink, in addition to water, include water-miscible solvents such as glycols, e.g. glycerol, ethylene glycol, propylene glycol, diethylene glycol, and thiodiglycol; glycol ethers, e.g. methyl carbitol, ethyl carbitol, butyl carbitol, methyl Cellosolve, ethyl Cellosolve, triethylene glycol monomethyl ether, and triethylene glycol monoethyl ether; and nitrogen-containing solvents, e.g. N-methyl-2-pyrrolidone, 1,3-dimethyl-2-imidazolidinone, and formamide. Suitable contents of water in the ink are in the range of 10–90% by weight.

The method of the present invention is described in more detail by referring to the following examples. The word "part" in examples is based on weight.

EXAMPLE 1a

As the transparent substrate, a polyethyleneterephthalate film (produced by Toray) with a thickness of 100 μm was employed, and a coating solution A having the composition shown below was applied on the film to a film thickness of 20 μm after drying by the bar coater method, followed by drying under the conditions of 60° C. and 20 minutes, to form an under layer. Then, a coating solution B shown below was applied on the under layer to a dried film thickness of 3 μm, followed by drying at 60° C. for 15 minutes to form an upper layer, thus giving a transparent recording medium of the present invention.

| | |
|---|---|
| Composition of coating solution A: | |
| Polyvinyl pyrrolidone K-90 (produced by GAF) | 15 parts |
| Water | 85 parts |
| Composition of coating solution B: | |
| Carboxymethyl cellulose (Cellogen BS, produced by Daiichi Kogyo Seiyaku K.K.) | 2 parts |
| Water | 98 parts |

The recording medium of the present invention thus obtained was colorless and transparent. For this recording medium, by use of the four kinds of inks as shown below, ink jet recording was practiced by means of a recording device having an on-demand type ink jet recording head which discharged ink by a piezo vibrator (discharging orifice diameter 65 μm, driving voltage for piezo vibrator 70 V, frequency 3 KHz).

| | |
|---|---|
| Yellow ink (composition) | |
| C.I. Direct Yellow 86 | 2 parts |
| N—methyl-2-pyrrolidone | 10 parts |
| Diethylene glycol | 20 parts |
| Polyethylene glycol #200 | 15 parts |
| Water | 55 parts |
| Magenta ink (composition) | |
| C.I. Acid Red 35 | 2 parts |
| N—methyl-2-pyrrolidone | 10 parts |
| Diethylene glycol | 20 parts |
| Polyethylene glycol #200 | 15 parts |
| Water | 55 parts |
| Cyan ink (composition) | |
| C.I. Direct Blue 86 | 2 parts |
| N—methyl-2-pyrrolidone | 10 parts |
| Diethylene glycol | 20 parts |
| Polyethylene glycol #200 | 15 parts |
| Water | 55 parts |
| Black ink (composition) | |
| C.I. Food Black 2 | 2 parts |
| N—methyl-2-pyrrolidone | 10 parts |
| Diethylene glycol | 20 parts |
| Polyethylene glycol #200 | 15 parts |
| Water | 55 parts |

The evaluation results of the recording medium in this example are shown in Table 1a. The respective evaluation items in Table 1a were measured according to the following methods.

(1) Ink fixing time was determined by measuring the time until no ink was attached to fingers when the recording medium after recording was left to stand at room temperature and the recorded image was touched with fingers.

(2) The ink dot density was measured for black dots by means of Sakura Microdensitometer PDM-5 (produced by Konishiroku Shashin Kogyo K.K.) by applying JIS K 7505 for printed letter microdots.

(3) OHP aptitude was measured as a typical example of optical instrument and judged by observation with eyes of the recorded image which was projected on a screen by OHP, with the non-recorded portion being light and the recorded image giving a clear projected image of high OD (optical density) and high contrast being rated as O; with the non-recorded portion slightly dark and the recorded image with slightly lower OD, showing lines with pitch width of 0.5 mm and thickness of 0.25 mm which could not clearly be discriminated from each other being rated as Δ; with the non-recorded portion which is considerably dark and the recorded image showing lines with pitch width of 1 mm and thickness of 0.3 mm which could not clearly be discriminated from each other or the recorded image which could not be discriminated from the non-recorded portion being rated as X.

(4) Linear transmission factor was determined from the above formula (1) by measuring the spectral transmittance by means of Model 323 Hitachi Autorecording Spectrophotometer (produced by Hitachi Seisakusho) by maintaining the distance from the sample to the window on the light-receiving side at 9 cm.

EXAMPLE 2a

Except for using an art paper as the substrate, according to the same method as in Example 1a, a recording medium of the present invention was prepared. This recording medium was white and opaque. For the recording medium, the same ink jet recording was practiced similarly as in Example 1a, and the recording characteristics were evaluated similarly as in Example 1a. The results are shown in Table 1a.

EXAMPLE 3a

By use of a polyethyleneterephthalate film with a thickness of 100 μm (produced by Teijin, Ltd.), and a coating solution A having the composition shown below was applied on the film to a film thickness of 100 μm after drying by the bar coater method, followed by drying under the conditions of 80° C. and one hour, to form an under layer. Then, a coating solution B shown below was applied on the under layer to a dried film thickness of 5 μm, followed by drying at 80° C. for 20 minutes to form an upper layer. Further, the under layer together with the upper layer were peeled off from the polyethyleneterephthalate film to give a light-transmissive recording medium of the present invention.

| | |
|---|---|
| Composition of coating solution A: | |
| Polyvinyl alcohol (PVA 420, produced by Kuraray) | 10 parts |
| Water | 90 parts |
| Composition of coating solution B: | |
| Acrylic acid ester (Dicalac S 1235) | 5 parts |
| Ethanol | 95 parts |

For the recording medium, ink jet recording was practiced similarly as in Example 1a, and the recording characteristics were evaluated similarly as in Example 1a to obtain the results as shown in Table 1a.

EXAMPLE 4a

By use of an art paper as the substrate, a coating solution A having the composition shown below was applied on the substrate to a film thickness of 25 μm after drying by the bar coater method, followed by drying under the conditions of 50° C. and 20 minutes, to form an under layer. Then, a coating solution B shown below was applied on the under layer to a dried film thickness of 2 μm, followed by drying at 70° C. for 10 minutes to form an upper layer, thus giving a opaque recording medium of the present invention.

| | |
|---|---|
| Composition of coating solution A: | |
| Water-soluble acrylic resin (Cogam HW-7, produced by Showa Kobunshi Co.) | 20 parts |
| Fine powdery silica (Siloid #244, produced by Fuji Davidson Co.) | 5 parts |
| Water | 75 parts |
| Composition of coating solution B: | |
| Polyvinyl acetate (Movinyl 303, produced by Hoechst AG) | 10 parts |
| Water | 90 parts |

For the recording medium, the same ink jet recording as in Example 1a was practiced, and the recording characteristics were evaluated similarly as in Example 1a to obtain the results as shown in Table 1a.

COMPARATIVE EXAMPLES 1a, 2a AND 4a

Except for forming no upper layer, recording media for comparative purpose were prepared similarly as in Examples 1a, 2a, and 4a, and the same ink jet recording as in Example 1a was practiced for these recording media. The results of evaluation of recording characteristics conducted similarly as in Example 1a are shown in Table 1a.

COMPARATIVE EXAMPLE 3a

Except for forming no under layer, a recording medium for comparative purpose was prepared similarly as in Example 1a and the same ink jet recording as in Example 1a was practiced for this recording medium. The results of evaluation of the recording characteristics conducted similarly as in Example 1a are shown in Table 1a.

TABLE 1a

| | Example | | | |
|---|---|---|---|---|
| | 1a | 2a | 3a | 4a |
| Ink fixing time | | | | |
| 20° C., 65% RH | 1.5 min. | 1.5 min. | 45 sec. | 1.5 min. |
| 20° C., 85% RH | 1 min. | 1 min. | 30 sec. | 45 sec. |
| Linear transmission factor | 76% | — | 78% | — |
| Dot density | 0.9 | 1.2 | 1.0 | 1.0 |
| OHP aptitude | | — | | — |

TABLE 1a-continued

| | Comparative example | | | |
|---|---|---|---|---|
| | 1a | 2a | 3a | 4a |
| Ink fixing time | | | | |
| 20° C., 65% RH | 3 min. | 3 min. | >30 min. | 10 min. |
| 20° C., 85% RH | NR* | NR | 30 min. | NR |
| Linear transmission factor | 78% | — | 80% | — |
| Dot density | 0.9 | 1.2 | 1.1 | 1.0 |
| OHP aptitude | | — | | — |

*NR means that the recorded image was sticky and no recording was possible.

EXAMPLE 1b

As the transparent substrate, a polyethyleneterephthalate film (produced by Toray) with a thickness of 100 μm was employed, and a coating solution A having the composition shown below was applied on the film to a film thickness of 20 μm after drying by the bar coater method, followed by drying under the conditions of 60° C. and 20 minutes, to form an under layer. Then, a coating solution B shown below was applied on the under layer to a dried film thickness of 3 82 m, followed by drying at 60° C. for 5 minutes to form a microporous upper layer, thus giving a transparent recording medium of the present invention.

| | |
|---|---|
| Composition of coating solution A: | |
| Styrene-maleic acid monoester copolymer (Discoat-N-14, produced by Daiichi Kogyo Seiyaku) | 15 parts |
| Water | 85 parts |
| Composition of coating solution B: | |
| Polyether polyurethane (Tricoat G, produced by Taiho Kogyo Co.) | 20 parts |
| Acetone | 80 parts |

The recording medium of the present invention thus obtained was colorless and transparent.

EXAMPLE 2b

Except for using an art paper as the substrate, according to the same method as in Example 1b, a recording medium of the present invention was prepared. This recording medium was white and opaque, and the sizes of the micropores were the same as in Example 1b.

EXAMPLE 3b

By use of a polyethyleneterephthalate film with a thickness of 100 μm (produced by Teijin, Ltd.), a coating solution A having the composition shown below was applied on the film to a film thickness of 100 μm after drying by the bar coater method, followed by drying under the conditions of 80° C. and one hour, to form an under layer. Then, a coating solution B shown below was applied on the under layer to a dried film thickness of 1 μm, followed by drying at 80° C. for 10 minutes to form an upper layer. Further, the under layer together with the upper layer were peeled off from the polyethyleneterephthalate film to give a light-transmissive recording medium of the present invention.

| | |
|---|---|
| Composition of coating solution A: | |
| Polyvinyl alcohol (PVA 220, produced by Kuraray Co.) | 10 parts |
| Water | 90 parts |
| Composition of coating solution B: | |

-continued

| | |
|---|---|
| Water-dispersible urethane resin (Superflex 200, produced by Daiichi Kogyo Seiyaku Co.) | 20 parts |
| Water | 80 parts |

EXAMPLE 4b

By use of an art paper as the substrate, a coating solution A having the composition shown below was applied on the substrate to a film thickness of 25 μm after drying by the bar coater method, followed by drying under the conditions of 50° C. and 20 minutes, to form an under layer. Then, a mixture of coating solutions B-1 and B-2 shown below at a ratio of 2:1 (weight ratio) was applied on the under layer to a dried film thickness of 0.5 μm, followed by drying at 70° C. for 5 minutes to form an upper layer, thus giving a recording medium of the present invention.

| | |
|---|---|
| Composition of coating solution A: | |
| Water-soluble acrylic resin (Cogam HW-7, Produced by Showa Kobunshi Co.) | 20 parts |
| Fine powdery silica (siloid #244, produced by Fuji Davidson Co.) | 5 parts |
| Water | 75 parts |
| Composition of coating solution B-1: | |
| Polyester (Desmophen 800, Bayer) | 5 parts |
| Polyester (Desmophen 1100, Bayer) | 5 parts |
| Solvent mixture (ethyl acetate/methyl cellosolve/toluene = 1/1/1) | 90 parts |
| Composition of coating solution B-2: | |
| Polyisocyanate (Coronate L, produced by Nippon Polyurethane Kogyo Co.) | 38 parts |
| Toluene | 62 parts |

For the recording media obtained in the above Examples 1b–4b, by using the same four kinds of ink as in Example 1a, ink jet recording was performed similarly as in Example 1a. The recording characteristics were evaluated in the same manner as in Example 1a. The evaluation results of the recording media of Examples 1b–4b are shown in Table 1b.

COMPARATIVE EXAMPLES 1b–2b

Except for employing the coating solutions having the compositions shown below as the coating solution B, Example 1b was repeated to prepare recording media for comparative purpose, for which the same ink jet recording was practiced as in Examples 1b–4b. The evaluation results of recording characteristics performed in the same manner as in Examples 1b–4b are shown in Table 1b.

| | |
|---|---|
| Composition of coating solution in Comparative example 1b: | |
| Alkyd resin (Hariphthal COG-40-50T, produced by Harime Kasei Co.) | 10 parts |
| Xylene | 90 parts |
| Composition of coating solution in Comparative example 2b: | |
| Polyaminoacid resin (Ajicoat TC-10, produced by Ajinomoto Co.) | 10 parts |
| Ethyl acetate | 45 parts |
| Toluene | 45 parts |

TABLE 1b

| | 1b | 2b | 3b | 4b |
|---|---|---|---|---|
| Ink fixing time | | | | |
| 20° C., 65% RH | 1 min. | 1 min. | 1 min. 15 sec. | 1 min. 30 sec. |
| 20° C., 85% RH | 45 sec. | 45 sec. | 1 min. | 1 min. 45 sec. |
| Linear transmission factor | 72% | — | 80% | — |
| Dot density | 0.9 | 1.0 | 1.0 | 1.0 |
| OHP aptitude | | — | | — |

TABLE 1b-continued

| | Comparative example 1b | Comparative example 2b |
|---|---|---|
| Ink fixing time | | |
| 20° C., 65% RH | 30 min. | 13 min. |
| 20° C., 85% RH | 30 min. | 12 min. |
| Linear transmission factor | 76% | 80% |
| Dot density | 0.9 | 1.0 |
| OHP aptitude | | |

EXAMPLE 1c

As the transparent substrate, a polyethyleneterephthalate film (produced by Toray) with a thickness of 100 μm was employed, and a coating solution A having the composition shown below was applied on the film to a film thickness of 10 μm after drying by the bar coater method, followed by drying under the conditions of 60° C. and 20 minutes, to form an under layer. Then, a coating solution B shown below was applied on the under layer to a dried film thickness of 1 μm, followed by drying at 60° C. for 15 minutes to form an upper layer, thus giving a transparent recording medium of the present invention.

| | |
|---|---|
| Composition of coating solution A: | |
| Water-soluble acrylic resin (Cogam HW-7, produced by Showa Kobunshi Co.) | 20 parts |
| Polyvinyl alcohol (PVA-420, produced by Kuraray Co.) | 5 parts |
| Water | 75 parts |
| Composition of coating solution B: | |
| Hydrophilic urethane resin (Tricoat G, produced by Taiho Kogyo Co.) | 10 parts |
| Acetone | 90 parts |

The recording medium of the present invention thus obtained was colorless and transparent.

EXAMPLE 2c

Except for using an art paper as the substrate, according to the same method as in Example 1c, a recording medium of the present invention was prepared.

EXAMPLE 3c

By use of a polyethyleneterephthalate film with a thickness of 100 μm (produced by Teijin, Ltd.), a coating solution A having the composition shown below was applied on the film to a film thickness of 100 μm after drying by the bar coater method, followed by drying under the conditions of 80° C. and one hour, to form an under layer. Then, a coating solution B shown below was applied on the under layer to a dried film thickness of 3 μm, followed by drying at 80° C. for 20 minutes to form an upper layer. Further, the under layer together with the upper layer were peeled off from the polyethyleneterephthalate film to give a light-transmissive recording medium of the present invention.

| |
|---|
| Composition of coating solution A: |

-continued

| | |
|---|---|
| Polyvinyl alcohol (PVA 220, produced by Kuraray Co.) | 5 parts |
| Polyvinyl pyrrolidone (PVP D-90 produced by GAF) | 5 parts |
| Water | 90 parts |
| Composition of coating solution B: | |
| Carboxymethyl cellulose (Celogen BS, produced by Daiichi Kogyo Seiyaku Co.) | 2 parts |
| Water | 98 parts |

EXAMPLE 4c

By use of the same material as used in Example 1c as the substrate, a coating solution A having the composition shown below was applied on the substrate to a film thickness of 8 μm after drying by the bar coater method, followed by drying under the conditions of 50° C. and 20 minutes, to form an under layer. Then, a coating solution B shown below was applied on the under layer to a dried film thickness of 2 μm, followed by drying at 70° C. for 10 minutes to form an upper layer, thus giving a recording medium of the present invention.

| | |
|---|---|
| Composition of coating solution A: | |
| Hydroxyethyl cellulose (HEC AH-15, produced by Fuji Chemical Co.) | 5 parts |
| Water | 95 parts |
| Composition of coating solution B: | |
| Acrylic resin (Dicalac S-1235, produced by Daido Kasei Kogyo C.) | 5 parts |
| Water | 95 parts |

COMPARATIVE EXAMPLES 1c–2c

Except for forming no upper layer, recording media for comparative purpose were prepared in the same manner as in Examples 1c and 3c.

COMPARATIVE EXAMPLE 3c

Example 1c was repeated except that the thickness of the under layer was changed to 1 μm and the upper layer to 10 μm to prepare a recording medium for comparative purpose.

COMPARATIVE EXAMPLE 4c

Example 4c was repeated that the thickness of the under layer was changed to 2 μm and the upper layer to 15 μm to prepare a recording medium for comparative purpose.

For the recording media of the above examples and comparative examples, by using the same four kinds of ink as in Example 1a, the ink jet recording was practiced similarly as in Example 1a. The recording characteristics were evaluated in the same manner as in Example 1a.

The evaluation results of the above Examples 1c–4c and Comparative examples 1c–4c are shown in Table 1c.

TABLE 1c

| | Example | | | |
|---|---|---|---|---|
| | 1c | 2c | 3c | 4c |
| Ink fixing time | | | | |
| 20° C., 65% RH | 15 sec. | 15 sec. | 45 sec. | 15 sec. |
| 20° C., 85% RH | 15 sec. | 15 sec. | 45 sec. | 30 sec. |
| Linear transmissive factor | 78% | — | 80% | — |
| Dot density | 0.9 | 1.2 | 1.0 | 1.0 |
| OHP aptitude | — | | | |

TABLE 1c-continued

| | Comparative example | | | |
|---|---|---|---|---|
| | 1c | 2c | 3c | 4c |
| Ink fixing time | | | | |
| 20° C., 65% RH | 1 min. | 1 min. | 3 min. | >30 min. |
| 20° C., 85% RH | NR* | NR | 15 min. | 30 min. |
| Linear transmissive factor | 80% | 78% | 72% | 78% |
| Dot density | 1.0 | 1.0 | 0.8 | 1.0 |
| OHP aptitude | | | | |

*NR means that no recording was possible.

EXAMPLE 1d

As the transparent substrate, a polyethyleneterephthalate film (produced by Toray Co.) with a thickness of 100 μm was employed, and a coating solution A having the composition shown below was applied on the film to a film thickness of 10 μm after drying by the bar coater method, followed by drying under the conditions of 60° C. and 20 minutes, to form an under layer. Then, a coating solution B shown below was applied on the under layer to a dried film thickness of 1 μm, followed by drying at 60° C. for 15 minutes to form an upper layer, thus giving a transparent recording medium of the present invention.

| | |
|---|---|
| Composition of coating solution A: | |
| Water-soluble acrylic resin (Cogam WH-7, produced by Shows Kobunshi Co.) | 20 parts |
| Polyvinyl alcohol (PVA-420, produced by Kuraray Co.) | 5 parts |
| Water | 75 parts |
| Composition of coating solution B: | |
| Hydrophilic urethane resin (Tricoat G, produced by Taiho Kogyo Co.) | 10 parts |
| Acetone | 90 parts |

The recording medium of the present invention thus obtained was colorless and transparent.

EXAMPLE 2d

Except for using an art paper as the substrate, according to the same method as in Example 1d, a recording medium of the present invention was prepared.

EXAMPLE 3d

By use of a polyethyleneterephthalate film with a thickness of 100 μm (produced by Teijin, Ltd.), a coating solution A having the composition shown below was applied on the film to a film thickness of 100 μm after drying by the bar coater method, followed by drying under the conditions of 80° C. and one hour, to form an under layer. Then, a coating solution B shown below was applied on the under layer to a dried film thickness of 3 μm, followed by drying at 80° C. for 20 minutes to form an upper layer. Further, the under layer together with the upper layer were peeled off from the polyethyleneterephthalate film to give a light-transmissive recording medium of the present invention.

| | |
|---|---|
| Composition of coating solution A: | |
| Polyvinyl alcohol (PVA 220, produced by Kuraray Co.) | 5 parts |
| Polyvinyl pyrrolidone (PVP K-90 produced by GAF) | 5 parts |
| Water | 90 parts |
| Composition of coating solution B: | |
| Carboxymethyl cellulose (Celogen BS, produced by Daiichi Kogyo Seiyaku Co.) | 2 parts |

-continued

| | |
|---|---|
| Water | 98 parts |

EXAMPLE 4d

By use of the same material as used in Example 1d as the substrate, a coating solution A having the composition shown below was applied on the substrate to a film thickness of 8 μm after drying by the bar coater method, followed by drying under the conditions of 50° C. and 20 minutes, to form an under layer. Then, a coating solution B shown below was applied on the under layer to a dried film thickness of 2 μm, followed by drying at 70° C. for 10 minutes to form an upper layer, thus giving a recording medium of the present invention.

| | |
|---|---|
| Composition of coating solution A: | |
| Hydroxyethyl cellulose (HEC AH-15, produced by Fuji Chemical Co.) | 5 parts |
| Water | 95 parts |
| Composition of coating solution B: | |
| Acrylic resin (Dicalac S-1235, produced by Daido Kasei Kogyo Co.) | 5 parts |
| Water | 95 parts |

COMPARATIVE EXAMPLES 1d–2d

Except for forming no upper layer, recording media for comparative purpose were prepared in the same manner as in Examples 1d and 3d.

COMPARATIVE EXAMPLES 3d–4d

Examples 1d and 4d were repeated except that the thickness of the upper layer was changed to 20 μm and 15 μm, respectively, to prepare recording media for comparative purpose.

The evaluation results of the above Examples 1d–4d and Comparative examples 1d–4d are shown in Table 1d.

TABLE 1d

| | Example | | | |
|---|---|---|---|---|
| | 1d | 2d | 3d | 4d |
| Ink fixing time | | | | |
| 20° C., 65% RH | 15 sec. | 15 sec. | 45 sec. | 15 sec. |
| 20° C., 85% RH | 15 sec. | 15 sec. | 45 sec. | 30 sec. |
| Linear transmission factor | 78% | — | 80% | 81% |
| Dot density | 0.9 | 1.2 | 1.0 | 1.0 |
| OHP aptitude | | — | | |
| | **Comparative example** | | | |
| | 1d | 2d | 3d | 4d |
| Ink fixing time | | | | |
| 20° C., 65% RH | 1 min. | 1 min. | 3 min. | >30 min. |
| 20° C., 85% RH | NR* | NR* | 15 min. | 30 min. |
| Linear transmission factor | 80% | 78% | 70% | 78% |
| Dot density | 1.0 | 1.0 | 0.8 | 1.0 |
| OHP aptitude | | | | |

*NR means that no recording was possible.

REFERENCE EXAMPLE 1e

As the light-transmissive substrate, a polyethyleneterephthalate film (produced by Toray) with a thickness of 100 μm was employed, and a coating solution A having the composition shown below was applied on the film to a film thickness of 10 μm after drying by the bar coater method, followed by drying under the conditions of 60° C. and 20 minutes, to form an under layer. Then, a coating solution B shown below was applied on the under layer to a dried film thickness of 3 μm, followed by drying at 60° C. for 15 minutes to form an upper layer, thus giving a light-transmissive recording medium for referential purpose.

| | |
|---|---|
| Composition of coating solution A: | |
| Polyvinyl pyrrolidone K-90 (produced by GAF) | 15 parts |
| Water | 85 parts |
| Composition of coating solution B: | |
| Carboxymethyl cellulose (Cellogen BS, produced by Daiichi Kogyo Seiyaku Co.) | 2 parts |
| Water | 98 parts |

The recording medium of the present invention thus obtained was colorless and transparent.

REFERENCE EXAMPLE 2e

Except for using an art paper as the substrate, according to the same method as in Reference example 1e, a recording medium for referential purpose was prepared. This recording medium was white and opaque.

REFERENCE EXAMPLE 3e

By use of a polyethyleneterephthalate film with a thickness of 100 μm (produced by Teijin), a coating solution A having the composition shown below was applied on the film to a film thickness of 100 μm after drying by the bar coater method, followed by drying under the conditions of 80° C. and one hour, to form an under layer. Then, a coating solution B shown below was applied on the under layer to a dried film thickness of 5 μm, followed by drying at 80° C. for 20 minutes to form an upper layer. Further, the under layer together with the upper layer were peeled off from the polyethyleneterephthalate film to give a light-transmissive recording medium for referential purpose.

| | |
|---|---|
| Composition of coating solution A: | |
| Polyvinyl alcohol (PVA 420, produced by Kuraray Co.) | 10 parts |
| Water | 90 parts |
| Composition of coating solution B: | |
| Acrylic acid ester (Dicalac S 1235) | 5 parts |
| Ethanol | 95 parts |

REFERENCE EXAMPLE 4e

By use of an art paper as the substrate, a coating solution A having the composition shown below was applied on the substrate to a film thickness of 25 μm after drying by the bar coater method, followed by drying under the conditions of 50° C. and 20 minutes, to form an under layer. Then, a coating solution B shown below was applied on the under layer to a dried film thickness of 2 μm, followed by drying at 70° C. for 10 minutes to form an upper layer, thus giving a non-light-transmissive recording medium for referential purpose.

| | |
|---|---|
| Composition of coating solution A: | |
| Water-soluble acrylic resin (Cogam HW-7, produced by Showa Kokunshi Co.) | 20 parts |
| Fine powdery silica (Siloid #244, | 5 parts |
| Water | 75 parts |
| Composition of coating solution B: | |

-continued

| | |
|---|---|
| Polyvinyl acetate (Movinyl 303, produced by Hoecst AG) | 10 parts |
| Water | 90 parts |

EXAMPLE 1e

The upper layer prepared in reference example 1e was coated by a brush with clay (particle distribution 0.1 to 5 μm, produced by Tsuchiya Kaolin Co.) or zeolite (particle distribution 0.5 to 5 μm, produced by Takeda Yakuhin Co.) to proportions of 0.5 g/m$^2$ and 1.0 g/m$^2$, respectively, and excessive powder was wiped off with a cloth or a brush, to give a transparent recording medium of the present invention.

EXAMPLE 2e

The upper layer prepared in Reference example 2e was coated by a brush with calcium carbonate (particle distribution 0.05 to 3 μm, produced by Nitto Hunka Co.) or hydrous silicon dioxide (particle size about 15 μm, produced by Fuji Davidson Co.) to proportions of 0.5 g/m$^2$ and 0.2 gm$^2$, respectively, and excess powder was wiped off with a cloth or a brush, to give a recording medium of the present invention.

EXAMPLE 3e

The upper layer prepared in Reference example 3e was coated by a brush with anhydrous silicon dioxide (particle size 30 mμm, produced Nippon Aerozil Co.) or diatomaceous earth (particle size distribution 0.05 to 5 μm, produced by Nitto Hunka Co.) to proportions of 0.1 g/m$^2$ and 0.4 g/m$^2$, respectively, and excessive powder was wiped off with a cloth or a brush, to give a recording medium of the present invention.

EXAMPLE 4e

The upper layer prepared in Reference example 4e was coated by a brush with clay (particle distribution 0.1 to 5 μm, produced by Tsuchiya Kaolin Co.) or calcium carbonate (particle distribution 0.05 to 3 μm, produced by Nitto Hunka Co.) to proportions of 0.8 g/m$^2$ and 0.5 g/m$^2$, respectively, and excessive powder was wiped off with a cloth or a brush, to give a recording medium of the present invention.

For the recording media obtained in the above reference examples and examples, ink jet recording was practiced, by use of the same four kinds of inks as in Example 1a, similarly as in Example 1a. The recording characteristics were evaluated similarly as in Example 1a. The results of evaluation of Examples 1e to 4e and Reference examples 1e to 4e are shown in Table 1e.

TABLE 1e

| | Example | | | |
|---|---|---|---|---|
| | 1e | 2e | 3e | 4e |
| Ink fixing time | | | | |
| 20° C., 65% RH | 1 min. | 1 min. | 30 sec. | 45 sec. |
| 20° C., 85% RH | 45 sec. | 45 sec. | 20 sec. | 30 sec. |
| Linear transmission factor | 76% | — | 77% | — |
| Dot density | 0.9 | 1.2 | 1.0 | 1.0 |
| OHP aptitude | | — | | — |
| | **Reference example** | | | |
| | 1e | 2e | 3e | 4e |
| Ink fixing time | | | | |
| 20° C., 65% RH | 1.5 min. | 1.5 min. | 45 sec. | 1.5 min. |
| 20° C., 85% RH | 1 min. | 1 min. | 30 sec. | 45 sec. |
| Linear transmission factor | 76% | — | 78% | — |
| Dot density | 0.9 | 1.2 | 1.0 | 1.0 |
| OHP aptitude | | — | | — |

EXAMPLE 1f

As the transparent substrate, a polyethyleneterephthalate film (produced by Teijin, Ltd.) with a thickness of 100 μm was employed, and a coating solution A having the composition shown below was applied on the film to a film thickness of 20 μm after drying by the bar coater method, followed by drying under the conditions of 60° C. and 20 minutes, to form an under layer. Then, a coating solution B shown below was applied on the under layer to a dried film thickness of 3 μm, followed by hardening at 70° C. for 5 minutes to form a porous upper layer, and further by coating of clay (Kaolin clay, produced by Tsuchiya Kaolin Co., particle size distribution 0.1 to 5 μm) at a proportion of 1.0 g/m$^2$ thereon, thus giving a transparent recording medium of the present invention.

| | |
|---|---|
| Composition of coating solution A: | |
| Styrene-maleic acid semiester copolymer (Discoat-N-14, produced by Daiichi Kogyo Seiyaku Co.) | 15 parts |
| Water | 85 parts |
| Composition of coating solution B: | |
| Polyether polyurethane (Tricoat G, produced by Taiho Kogyo Co.) | 20 parts |
| Acetone | 80 parts |

The recording medium of the present invention thus obtained was colorless and transparent.

EXAMPLE 2f

Except for using mica (Cericite FS-1, produced by Sanshin Koko, particle size distribution 0.5 to 5 μm) in place of the powder in Example 1f, according to the same method as in Example 1f, a recording medium of the present invention was prepared (amount of powder attached 0.8 g/m$^2$).

EXAMPLE 3f

Except for using anhydrous silicon oxide (Aerozil MOX-80, produced by Nippon Aerozil Co., average particle size 0.03 μm) in place of the powder in Example 1f, according to the same method as in Example 1f, a recording medium of the present invention was prepared (amount of powder attached 0.1 g/m$^2$).

EXAMPLE 4f

By use of a polyethyleneterephthalate film with a thickness of 100 μm (produced by Teijin, Ltd.), a coating solution A having the composition shown below was applied on the film to a film thickness of 100 μm after drying by the bar coater method, followed by drying under the conditions of 80° C. and one hour, to form an under layer. Then, a coating solution B shown below was applied on the under layer to a dried film thickness of 1 μm, followed by drying at 80° C. for 10 minutes to form an upper layer. Subsequently, an aqueous 5 wt. % dispersion of hydrous silicon dioxide (Siloid #161, produced by Fuji Davidson Co., average particle size 7 μm) was attached by spraying onto the upper layer at a proportion of 0.2 g/m$^2$. Further, the under layer together with the upper layer were peeled off from the polyethyleneterephthalate film to give a transparent recording medium of the present invention.

| | |
|---|---|
| Composition of coating solution A: | |
| Polyvinyl alcohol (PVA 220, produced by Kuraray Co.) | 10 parts |
| Water | 90 parts |
| Composition of coating solution B: | |
| Water-dispersible urethane resin (Superflex 200, produced by Daiichi Kogyo Seiyaku) | 20 parts |
| Water | 80 parts |

EXAMPLE 5f

Example 4f was repeated except that calcium carbonate (Newlight F, produced by Nitto Hunka Co., particle size distribution 0.05 to 3 μm) was employed in place of the powder in Example 4f to obtain a recording medium of the present invention (amount of powder attached 0.5 g/m$^2$).

EXAMPLE 6f

Example 4f was repeated except that diatomaceous earth (Radiolight, produced by Showa Kagaku Kogyo Co., particle size distribution 0.5 to 5 μm) was employed in place of the powder in Example 4f to obtain a recroding medium of the present invention (amount of powder attached 0.4 g/m$^2$).

COMPARATIVE EXAMPLES 1f–2f

Examples 1f and 4f were repeated except that no powder was imparted to prepare recording media for comparative purpose.

For the recording media obtained in Examples 1f–6f and Comparative examples 1f–2f, by use of the same four kinds of ink as employed in Example 1a, the same ink jet recording was practiced similarly as in Example 1a, and their recording characteristics were evaluated similarly as in Example 1a. In addition, delivering characteristic, fingerprint resistance and blocking resistance were also evaluated according the methods as described below.

The evaluation results of Examples 1f–4f and Comparative examples 1f–2f are shown in Table 1f.

(i) Delivering characteristic: the recording medium was cut into A4 sizes and applied to an ink jet printer (Canon A 1210) and the number until the recording meidum became unmovable before completion of printing of A4 sizes was counted for evaluation;

(ii) Fingerprint resistance: ten fingers of both hands were pressed against the recorded surface of the recording medium, and the number of fingerprints remained on the surface was counted for evaluation;

(iii) Blocking resistance: the recording medium was cut into A4 sizes, of which 50 sheets were piled and a plate was placed thereon under loading of 10 kg, followed by leaving to stand in a room for one month, and thereafter the load was removed for observation of blocking; those without any blocking are represented by O, while those with blocking by X.

TABLE 1f

| | Example | | | | | | Comparative example | |
|---|---|---|---|---|---|---|---|---|
| | 1f | 2f | 3f | 4f | 5f | 6f | 1f | 2f |
| Ink fixing time | | | | | | | | |
| 20° C., 65% RH | 30 sec. | 40 sec. | 35 sec. | 50 sec. | 40 sec. | 45 sec. | 1 min. | 1 min. 15 sec. |
| Linear transmission factor | 70% | 70% | 68% | 78% | 76% | 80% | 72% | 80% |
| Dot density | 0.9 | 1.0 | 1.0 | 1.1 | 1.2 | 1.1 | 0.9 | 1.0 |
| OHP aptitude | | | | | | | | |
| Delivering characteristic | 0 | 0 | 0 | 0 | 0 | 0 | >50 | >50 |
| Fingerprint resistance | 1 | 0 | 0 | 0 | 1 | 0 | 10 | 10 |
| Blocking resistance | | | | | | | X | X |

EXAMPLE 1g

As the transparent substrate, a polyethyleneterephthalate film (produced by Toray Co.) with a thickness of 100 μm was employed, and a coating solution A having the composition shown below was applied on the film to a film thickness of 10 μm after drying by the bar coater method, followed by drying under the conditions of 80° C. and 10 minutes, to form an under layer. Then, a coating solution B shown below was applied on the under layer to a dried film thickness of 1 μm, followed by curing at 60° C. for 5 minutes and then drying at 110° C. for one minute to form a microporous upper layer. Further, on the upper layer, Aerozil R-972 (anhydrous silicon dioxide, produced by Nippon Aerozil Co., average particle size 16 μm) was applied at a proportion of 0.1 to 0.2 g/m$^2$ to obtain a transparent recording medium of the present invention.

| | |
|---|---|
| Composition of coating solution A: | |
| Polyvinyl alcohol (PVA-420, produced by Kuraray Co.) | 5 parts |
| Polyacrylic acrylate (Cogam HW-7, produced by Showa Kobunshi Co.) | 20 parts |
| Water | 75 parts |
| Composition of coating solution B: | |
| Hydrophilic polyurethane (Tricoat G, produced by Taiho Kogyo Co.) | 10 parts |
| Yellow discoloration preventive (CHELEX-90, produced by Sakai Kagaku Co.) | 1 part |
| Acetone | 89 parts |

The recording medium of the present invention thus obtained was colorless and transparent.

EXAMPLE 2g

According to the same procedure as in Example 1g, except for changing the composition of the coating solution A as follows, a recording medium of the present invention was obtained.

| | |
|---|---|
| Composition of coating solution A; | |
| Polyvinyl alcohol (PVA 220, produced by Kuraray Co.) | 5 parts |
| Polyvinyl pyrrolidone (PVPK-90, produced by GAF) | 5 parts |
| Water | 90 parts |

EXAMPLE 3g

By use of a polyethyleneterephthalate film with a thickness of 100 μm (produced by Teijin, Ltd.), a coating solution A having the composition shown below was applied on the film to a film thickness of 100 μm after drying by the bar coater method, followed by drying under the conditions of 80° C. and one hour, to form an under layer. Then, a coating solution B shown below was applied on the under layer to a dried film thickness of 1 μm, followed by drying at 80° C. for 10 minutes to form an upper layer. Further, the ink retaining layer together with the upper layer were peeled off and then coated with Aerozil 300 (7 mμm) by a brush at a proportion of 0.2 g/m$^2$ to obtain a light-transmissive recording medium of the present invention.

| | |
|---|---|
| Composition of coating solution A: | |
| Polyvinyl alcohol (PVA 220, produced by Kuraray Co.) | 10 parts |
| Water | 90 parts |
| Composition of coating solution B: | |
| Water-dispersible urethane resin (Superflex 200, produced by Daiichi Kogyo Seiyaku Co.) | 20 parts |
| Water | 80 parts |

EXAMPLE 4g

By use of an art paper as the substrate, a coating solution A having the composition as shown below was applied to a film thickness of 25 μm, after drying on the substrate according to the bar coater method, followed by drying under the conditions of 50° C. and 20 minutes, to form an under layer. Then, the coating solution B-1 and B-2 shown below were mixed at a ratio of 2:1 (weight ratio) and applied to a dried film thickness of 0.5 μm, followed by heating drying at 70° C. for 5 minutes to form an upper layer. Subsequently, Aerozil MOX 170 (15 mum) was applied at a proportion of 0.1 g/m$^2$ to give a recording medium of the present invention.

| | |
|---|---|
| Composition of coating solution A: | |
| Water-soluble acrylic resin (Cogam HW-7, produced by Showa Kobunshi Co.) | 20 parts |
| Fine powdery silica (Siloid 244, produced by Fuji Davison Co.) | 5 parts |
| Water | 75 parts |
| Composition of coating solution B-1: | |
| Polyester (Desmophen 800, Bayer) | 5 parts |
| Polyester (Desmophen 1100, Bayer) | 5 parts |
| Solvent mixture (ethyl acetate butyl acetate/methyl sellosolve/toluene = 1/1/1/1) | 90 parts |
| Composition of coating solution B-2: | |
| Polyisocyanate (Coronate L, produced by Nippon Polyurethane Kogyl Co.) | 38 parts |
| Toluene | 62 parts |

For the recording media obtained in the above Examples 1g–4g, by using the same four kinds of ink as in Example 1a, ink jet recording was performed similarly as in Example 1a. The recording characteristics were evaluated in the same manner as in Example 1a. The evaluation results of the recording media of Examples 1g–4g are shown in Table 1g.

COMPARATIVE EXAMPLES 1g

By use of a 100 μm thick polyethyleneterephthalate film (produced by Toray Co.) as the light-transmissive substrate, a coating solution A as shown below was applied by the bar coater method to a film thickness after drying of 15 μm, followed by drying at 80° C. for 15 minutes to obtain a transparent recording medium.

| | |
|---|---|
| Composition of coating solution A: | |
| Polyvinyl alcohol (PVA-220, produced by Kuraray) | 10 parts |
| Water | 90 parts |

For this recording medium, the same ink jet recording was practiced similarly as in Example 1g and the recording characteristics were evaluated similarly as in Example 1g to obtain the results as shown in Table 1g.

COMPARATIVE EXAMPLE 2g

Comparative example 1g was repeated except for changing the composition of the coating solution A as follows:

| | |
|---|---|
| Coating solution composition: | |
| Gelatin (Heptide DBF, produced by Nippi Co.) | 5 parts |
| Water | 95 parts |

For this recording medium, the same ink jet recording was practiced similarly as in Example 1g and the recording characteristics were eveluated similarly as in Example 1g to obtain the results as shown in Table 1g.

TABLE 1g

| | Example | | | |
|---|---|---|---|---|
| | 1g | 2g | 3g | 4g |
| Ink fixing time | | | | |
| 20° C., 65% RH | <5 sec. | <5 sec. | 15 sec. | 30 sec. |
| 20° C., 85% RH | <5 sec. | <5 sec. | 10 sec. | 20 sec. |
| Linear transmission factor | 76% | 78% | 76% | 77% |
| Dot density | 0.8 | 0.8 | 0.8 | 0.8 |
| OHP aptitude | | — | | |

| | Comparative example | |
|---|---|---|
| | 1g | 2g |
| Ink fixing time | | |
| 20° C., 65% RH | 3 min. | 10 min. |
| 20° C., 85% RH | 10 min. | 20 min. |
| Linear transmission factor | 82% | 74% |
| Dot density | 1.2 | 1.1 |
| OHP aptitude | | |

EXAMPLES 1h–4h

By use of a polyethyleneterephthalate film with a thickness of 100 μm (produced by Toray Co., Q 80) as the transparent layer, aqueous 10% solutions of compositions for formation of under layers as shown in Table 1h shown below were applied thereon according to the bar coater method to the thicknesses as shown in Table 1h, followed by drying under the conditions of 120° C. and 3 minutes. Then, on the under layers, 1% acetone solutions of the compositions for formation of upper layers shown in Table 1h were applied on the upper layers according to the bar coater method to the thicknesses as shown in Table 1h, followed by drying under the conditions of 100° C. and one minute. Further, the fine powder layers as shown in Table 1h in proportions as shown in Table 1h were attached by spraying to give the transparent recording media of the present invention.

COMPARATIVE EXAMPLES 1h AND 2h

Examples 1h and 3h were repeated except that no upper layer was provided in Examples 1h and 3h to obtain recording media for comparative purpose.

COMPARATIVE EXAMPLES 3h AND 4h

Examples 1h and 2h were repeated except that the thickness of the upper layer was made 1 μm in Examples 1h and 2h to obtain recording media for comparative purpose.

COMPARATIVE EXAMPLE 5h

Example 1h was repeated except that the thickness of the upper layer was made 0.005 μm in Example 1h to obtain a recording medium for comparative purpose.

For the recording media obtained in the above Examples 1h–4h and Comparative examples 1h–5h, by use of the four kinds of inks as shown below, ink jet recording was practiced by means of a recording device having an on-demand type ink jet recording head which discharged ink by a piezo vibrator (discharging orifice diameter 60 μm, driving voltage for piezo vibrator 70 V, frequency 3 KHz).

| | |
|---|---|
| Yellow ink (composition) | |
| C.I. Direct Yellow 86 | 2 parts |
| Diethylene glycol | 20 parts |
| Polyethylene glycol #200 | 10 parts |
| Water | 70 parts |
| Magenta ink (composition) | |
| C.I. Acid Red 35 | 2 parts |
| Diethylene glycol | 20 parts |
| Polyethylene glycol #200 | 10 parts |
| Water | 70 parts |
| Cyan ink (composition) | |
| C.I. Direct Blue 86 | 2 parts |
| Diethylene glycol | 20 parts |
| Polyethylene glycol #200 | 10 parts |
| Water | 70 parts |
| Black ink (composition) | |
| C.I. Food Black 2 | 2 parts |
| Diethylene glycol | 20 parts |
| Polyethylene glycol #200 | 10 parts |
| Water | 70 parts |

The evaluation results of the recording medium in this Example are shown in Table 2h. The respective evaluation items in Table 2h were measured according to the following methods.

(1) Ink fixing time was determined by measuring the time until no ink was attached to fingers when the recording medium after recording was left to stand at room temperature and the recorded image was touched with fingers.

(2) The ink dot density was measured for black dots by means of Sakura Microdensitometer PDM-5 (produced by Konishiroku Shashin Kogyo K.K.) by applying JIS S 7505 for printed letter microdots.

(3) OHP aptitude was measured by printing 6 dots each for the same spot and observing the recorded image projected on the screen by OHP with eyes for evaluation of the white turbidity and the optical aptitude at the printed letter portion.

O: light at the portion to be recorded, with high OD (optical density) at the recorded image, giving projected images excellent in color developing with contrast and clearness;

X: dark at the printed letter portion, being inferior in color developing and clearness;

Δ: medium between O and X.

(4) Linear transmission factor determined from the above formula (1) by measuring the spectral transmittance by means of Model 323 Hitachi Auto-recording Spectrophotometer produced by Hitachi Seisakusho) by maintaining the distance from the sample to the window on the light-receiving side at 9 cm.

TABLE 1h

| | Under layer | | Upper layer | | Fine powder | |
|---|---|---|---|---|---|---|
| | Composition | Thickness (μm) | Composition | Thickness (μm) | Composition | Amount attached ($g/m^2$) |
| Example 1h | PVA-220/PVPK-90 = 1/1 | 6 | Tricoat G | 0.07 | Aerosil MOX-80 | 0.1 |
| Example 2h | PVA-200/PVPK-90 = 1/1 | 6 | Diboncoat A | 0.08 | Aerosil R-97 | 0.05 |
| Example 3h | PVA-220/HW-7 = 1/1 | 8 | Tricoat G | 0.09 | Aerosil MOX-80 | 0.05 |
| Example 4h | PVA-200/HW-7 = 1/1 | 6 | Diboncoat A | 0.04 | Aerosil | 0.1 |

Remarks:
*PVA: polyvinyl alcohol (produced by Kuraray)
*PVP: polyvinyl pyrrolidone (produced by GAF)
*HW: water-soluble acrylic resin (trade name Cogam, produced by Showa Kobunshi Co.)
*Tricoat G, Diboncoat A: hydrophilic polyurethane (produced by Taiho Kogyo Co.)
*Aerosil: fine powdery silica (produced by Nippon Aerosil Co.).

TABLE 2h

| | Ink fixing characteristic | | Dot | OHP | Linear trans- | Overall |
|---|---|---|---|---|---|---|
| | 20° C. 65% RH | 30° C. 85% RH | density | aptitude | mission factor | evaluation |
| Example 1h | within 10 sec. | within 10 sec. | 0.8 | | 78% | |
| Example 2h | within 10 sec. | within 10 sec. | 0.8 | | 78% | |
| Example 3h | within 10 sec. | within 10 sec. | 0.8 | | 76% | |
| Example 4h | within 30 sec. | within 20 sec. | 0.8 | | 77% | |
| Comparative example 1h | 1 min. | tacky & NR* | 0.8 | Δ | 80% | X |
| Comparative example 2h | within 10 sec. | within 10 sec. | 0.8 | Δ | 80% | X |
| Comparative example 3h | within 10 sec. | within 10 sec. | 0.8 | X | 77% | X |
| Comparative example 4h | within 10 sec. | within 10 sec. | 0.8 | X | 76% | X |
| Comparative example 5h | 1 min. | 3 min. | 0.8 | X | 80% | X |

*NR means that no recording was possible.

What is claimed is:

1. A recording medium suitable for recording with aqueous ink without direct contact with a recording member, comprising a substrate having thereon a water-sorptive under layer covered by an upper layer of substantially water-resistant polymeric material which is sufficiently thin to provide immediate water and air permeability.

2. The recording medium according to claim 1, wherein the upper layer is comprised of a polyurethane resin.

3. The recording medium according to claim 1, wherein the under layer is thicker than the upper layer.

4. The recording medium according to claim 1, wherein thickness of the upper layer is not more than 10 μm.

5. The recording medium according to claim 1, wherein a powdery material is applied on the surface of the upper layer.

6. The recording medium according to claim 1, wherein the upper layer is provided thereon with a fine-powder layer.

7. The recording medium according to claim 6, wherein each of the substrate and the layers is transparent, and the recording medium is transparent as a whole.

8. The recording medium according to claim 6, wherein at least one of the substrate and the layers is opaque and the recording medium is opaque as a whole.

9. The recording medium according to claim 1, wherein the under layer is comprised of a hydrophilic resin and the upper layer is comprised of a hydrophilic polyurethane resin.

10. The recording medium according to claim 1, wherein the upper layer is comprised of a polyurethane resin having a thickness in the range of from 0.01 μm to not more than 0.1 μm.

11. The recording medium according to claim 1, wherein the substrate and each of the layers is transparent, and the recording medium is transparent as a whole.

12. The recording medium according to claim 1 wherein at least one of the substrate and the layers is opaque, and the recording medium is opaque as a whole.

13. The recording medium according to claim 1, wherein substantially all of the pores in the upper layer are less than about 100 nanometers in size.

14. A recording process in which aqueous ink droplets are propelled onto a recording medium comprising a substrate having thereon a water-sorptive under layer covered by an upper layer of substantially water-resistant polymeric material which is sufficiently thin to provide immediate water and air permeability.

15. The recording process according to claim 14, wherein the process is an ink-jet recording process.

16. The recording process according to claim 14, wherein the aqueous ink contains a water miscible organic solvent.

17. The recording process according to claim 14, wherein the upper layer is comprised of a polyurethane resin.

18. The recording process according to claim 14, wherein the under layer is thicker than the upper layer.

19. The recording process according to claim 14, wherein thickness of the upper layer is not more than 10 μm.

20. The recording process according to claim 14, wherein a powdery material is applied on the surface of the upper layer.

21. The recording process according to claim 14, wherein the upper layer is provided thereon with a fine-powder layer.

22. The recording process according to claim 14, wherein the under layer is comprised of a hydrophilic resin and the upper layer is comprised of a hydrophilic polyurethane resin.

23. The recording process according to claim 14, wherein the upper layer is comprised of a polyurethane resin having a thickness in the range of from 0.01 μm to not more than 0.1 μm.

24. The recording process according to claim 14, wherein substantially all of the pores in the upper layer are less than about 100 nanometers in size.

* * * * *

UNITED STATES PATENT AND TRADEMARK OFFICE

CERTIFICATE OF CORRECTION

PATENT NO. : 4,642,247

DATED : February 10, 1987

INVENTOR(S) : HIDEMASA MOURI, ET AL.

It is certified that error appears in the above-identified patent and that said Letters Patent is hereby corrected as shown below:

COLUMN 1

Line 61, "the" should be deleted.

COLUMN 2

Line 32, "known, " should read --known--.

COLUMN 3

Line 16, "Further" should read --A further--.
Line 61, "and" should read --resin and--.
Line 67, "an sectional" should read --a sectional--.

COLUMN 4

Line 47, "In further" should read --In a further--.

COLUMN 5

Line 47, "transparent," should read --transparent;--.
Line 53, "transport" should read --transparent--.

COLUMN 6

Line 13, "primarily a" should read --primarily of a--.

COLUMN 10

Line 54, "a" should read --be an--.

UNITED STATES PATENT AND TRADEMARK OFFICE

CERTIFICATE OF CORRECTION

PATENT NO. : 4,642,247

DATED : February 10, 1987

INVENTOR(S) : HIDEMASA MOURI, ET AL.

It is certified that error appears in the above-identified patent and that said Letters Patent is hereby corrected as shown below:

COLUMN 11

Line 8, "is" should read --be--.
Line 26, "with" should read --will--.

COLUMN 12

Line 8, "having" should read --being--.
Line 12, "suffer" should read --suffers--.
Line 23, "investigation" should read --investigations--.
Line 29, "fine" should read --be fine--.
Line 58, "voids like capillary possesed by" should read --capillary-like voids--.
Line 59, "and" should read --and in--.

COLUMN 14

Line 12, "meduim" should read --medium--.
Line 15, "the layer" should read --the upper layer--.
Line 39, "be required" should read --required--.
line 55, "of" should read --or--.

COLUMN 17

Line 23, "a" should read --an--.

COLUMN 18

TABLE 1a,-continued, "OHP aptitude - - "
should read
OHP aptitude O - O - --.

UNITED STATES PATENT AND TRADEMARK OFFICE

CERTIFICATE OF CORRECTION

PATENT NO. : 4,642,247

DATED : February 10, 1987

INVENTOR(S) : HIDEMASA MOURI, ET AL.

It is certified that error appears in the above-identified patent and that said Letters Patent is hereby corrected as shown below:

COLUMN 18

Line 11, "OHP aptitude - - " should read --OHP aptitude O - O - --.

Line 24, "382m," should read --3μm,--.

COLUMN 19

Line 65, "1b 2b 3b 4b" should read --Example 1b 2b 3b 4b--.

COLUMN 20

Line 8, "OHP aptitude - - " should read --OHP aptitude O - O - --.

Line 17, "OHP aptitude " should read --OHP aptitude O O --.

COLUMN 21

Line 47, "repeated that" should read --repeated except that--.

UNITED STATES PATENT AND TRADEMARK OFFICE

CERTIFICATE OF CORRECTION

PATENT NO. : 4,642,247

DATED : February 10, 1987

INVENTOR(S) : HIDEMASA MOURI, ET AL.

It is certified that error appears in the above-identified patent and that said Letters Patent is hereby corrected as shown below:

COLUMN 22

Line 2, "OHP aptitude - " should read --OHP aptitude O - O O --.

Line 11, "OHP aptitude " should read --OHP aptitude O O O O --.

Line 32, "Shows" should read --Showa--.

COLUMN 23

Line 50, "OHP aptitude - " should read --OHP aptitude O - O O --.

Line 59, "OHP aptitude " should read --OHP aptitude O O O O --.

COLUMN 24

Line 65, "Kokunshi" should read --Kobunshi--.

Line 66, "(Siloid #244," should read --(Siloid #244, produced by Fuji Davidson Co.)--.

COLUMN 25

Line 2, "Hoecst AG)" should read --Hoechst AG)--.

Line 8, "reference" should read --Reference--.

Line 30, "30 mμm," should read --30 μm,--.

Line 62, "OHP aptitude - - " should read --OHP aptitude O - O - --.

UNITED STATES PATENT AND TRADEMARK OFFICE

CERTIFICATE OF CORRECTION

PATENT NO. : 4,642,247

DATED : February 10, 1987

INVENTOR(S) : HIDEMASA MOURI, ET AL.

It is certified that error appears in the above-identified patent and that said Letters Patent is hereby corrected as shown below:

COLUMN 26

Line 4, "OHP aptitude - - "
should read
--OHP aptitude O - O - --.

COLUMN 27

Line 40, "recroding" should read --recording--.
Line 56, "1f-4f" should read --1f-6f--.

COLUMNS 27-28

TABLE 1f, "OHP aptitude " should read
--OHP aptitude O O O O O O O O --.
TABLE 1f, "Blocking resistance X X "
should read
--Blocking resistance O O O O O O X X--.

COLUMN 28

Line 59, "A;" should read --A:--.

COULMN 29

Line 9, "(7 mμm)" should read --(7 μm)--.
Line 34, "(15 mum)" should read --(15 μm)--.
Line 48, "sellosolve" should read --Cellosolve--.
Line 61, "EXAMPLES" should read --EXAMPLE--.

UNITED STATES PATENT AND TRADEMARK OFFICE

CERTIFICATE OF CORRECTION

PATENT NO. : 4,642,247

DATED : February 10, 1987

INVENTOR(S) : HIDEMASA MOURI, ET AL.

It is certified that error appears in the above-identified patent and that said Letters Patent is hereby corrected as shown below:

COLUMN 30

Line 24, "eveluated" should read --evaluated--.

Line 35, "OHP aptitude - " should read --OHP aptitude O - O O --.

Line 42, "OHP aptitude " should read --OHP aptitude O O --.

COLUMN 32

Line 27, "Spectrophotometer produced" should read --Spectrophotometer (produced--.

TABLE 2h, " OHP " should read -- OHP --.

| | |
|---|---|
| aptitude | aptitude |
| | O |
| | O |
| | O |
| | O |
| Δ | Δ |
| Δ | Δ |
| X | X |
| X | X |
| X | X |

UNITED STATES PATENT AND TRADEMARK OFFICE

CERTIFICATE OF CORRECTION

PATENT NO. : 4,642,247

DATED : February 10, 1987

INVENTOR(S) : HIDEMASA MOURI, ET AL.

It is certified that error appears in the above-identified patent and that said Letters Patent is hereby corrected as shown below:

COLUMN 32

TABLE 2h, " Overall evaluation " should read -- Overall evaluation --.

| | |
|---|---|
| | O |
| | O |
| | O |
| | O |
| X | X |
| X | X |
| X | X |
| X | X |
| X | X |

COLUMN 33

Line 31, "1" should read --1,--.

Signed and Sealed this

Seventeenth Day of November, 1987

*Attest:*

DONALD J. QUIGG

*Attesting Officer*

*Commissioner of Patents and Trademarks*